US006975073B2

(12) United States Patent
Wakalopulos

(10) Patent No.: US 6,975,073 B2
(45) Date of Patent: Dec. 13, 2005

(54) ION PLASMA BEAM GENERATING DEVICE

(76) Inventor: George Wakalopulos, 220 14th St., Manhattan Beach, CA (US) 90266

( * ) Notice: Subject to any disclaimer, the term of this patent is extended or adjusted under 35 U.S.C. 154(b) by 0 days.

(21) Appl. No.: 10/688,424

(22) Filed: Oct. 16, 2003

(65) Prior Publication Data

US 2004/0232848 A1 Nov. 25, 2004

Related U.S. Application Data

(60) Provisional application No. 60/471,907, filed on May 19, 2003.

(51) Int. Cl.[7] ..... H01J 7/24
(52) U.S. Cl. ..... 315/111.81; 315/111.71
(58) Field of Search ..... 315/111.21, 111.31, 315/111.41, 111.81, 111.71, 111.91; 250/423 R, 250/427, 492.3

(56) References Cited

U.S. PATENT DOCUMENTS

| | | | | |
|---|---|---|---|---|
| 3,970,892 A | | 7/1976 | Wakalopulos | 315/111.3 |
| 4,025,818 A | | 5/1977 | Giguere et al. | 315/337 |
| 4,506,160 A | * | 3/1985 | Sugawara et al. | 250/427 |
| 4,641,031 A | * | 2/1987 | Ito et al. | 250/423 R |
| 4,755,722 A | | 7/1988 | Wakalopulos | 315/111.31 |
| 5,003,178 A | | 3/1991 | Livesay | 250/492.3 |
| 5,770,826 A | * | 6/1998 | Chaudhari et al. | 204/157.15 |
| 6,407,399 B1 | | 6/2002 | Livesay | 250/492.3 |
| 2003/0184235 A1 | * | 10/2003 | Nakamura | 315/111.21 |

* cited by examiner

*Primary Examiner*—Thuy Vinh Tran
(74) *Attorney, Agent, or Firm*—Schneck & Schneck; Thomas Schneck

(57) ABSTRACT

An electron beam device wherein a low temperature gaseous plasma is generated in a chamber divided by two parallel wire grids. A semiconductor wafer serves as a cathode drawing ions from the plasma to impinge on the wafer, generating secondary electrons that are accelerated toward an anode on the opposite side of the grids where a target resides. In order to have a beam with uniform cross-sectional flux characteristics, the semiconductor wafer is doped with a graded dopant concentration that promotes a uniform beam.

22 Claims, 2 Drawing Sheets

ION PLASMA BEAM GENERATING DEVICE

CROSS-REFERENCE TO RELATED APPLICATION

This application claims priority from U.S. provisional application No. 60/471,907 filed May 19, 2003.

TECHNICAL FIELD

The present invention relates to ion plasma devices for generating electron beams and, more specifically, to a wide area beam device.

BACKGROUND OF THE INVENTION

There is a present need for an irradiation device that can provide a uniform wide area beam. This would have a number of applications, including the processing of materials requiring electron beam exposure, such as in semiconductor manufacturing, sterilization, curing of polymers, etc. For example, in curing spin-on glass coatings on semiconductor wafers or CVD coatings, an electron beam may be used to drive off organic elements in the coating.

One technical challenge is to generate a uniform plasma that could provide an even areawise amount of energy to irradiate an object. Uniform large area electron beams are usually generated by scanning a small beam across the large area. Frequently, beam energy falls with the square of the radius from a scan center. Alternatively, space charge emission may be used to generate the uniform large area electron beam. This method relies on the voltage and the separation of the cathode and anode elements for the generation of the electron beam without dependence on the thermionic emitter. Beam non-uniformities are common.

In plasma devices, a gas is ionized and the ions bombard a target cathode. In such devices, space charge emission is not possible and the electron density is dependent on the ion density and surface state of the cathode. In a uniform electrical field, the ion extraction from the plasma can be uniform. Yet there is an edge effect where the beam is less dense at the edge of a beam pattern than at the center.

Prior art devices are described in U.S. Pat. Nos. 3,970,892 and 4,755,722. These patents disclose ion plasma electron guns using a vacuum chamber into which a low pressure gas is introduced. A high voltage cathode generates a plasma that is accelerated through control and shield grids into a second chamber containing a high voltage cold cathode. The positive ions bombard the cathode, causing the cathode to emit secondary electrons, forming a beam. The electron beam leaves the gun through a foil window. Control of this beam is accomplished by application of a control voltage between the grid and the grounded housing, to regulate the density of ions bombarding the cathode.

Another electron source is described in U.S. Pat. No. 5,003,178. This device includes a discharge cathode, a target anode, and a fine mesh grid spaced apart from the cathode a specified distance. Electrical bias of the grid allows control of the beam current. Scanning coils allow scanning the generated beam over a target.

To produce a more uniform beam, the grid may be arranged with varying depths or apertures. This arrangement can decrease the electrical field in the center of the discharge, decreasing the ion density at the center. This results in the attendant electron beam having a decreased electron density at the beam center, resulting in a more uniform beam. This is disclosed in U.S. Pat. No. 6,407,399, which teaches the use of a grid with apertures that are greater at the edges and smaller at the center.

If the ion beam is uniform, the electron beam uniformity depends only on the surface state of the cathode, which emits secondary electrons by ion bombardment. The secondary electron emission coefficient is a function of the material of which the cathode is comprised and the surface state of the cathode, which are highly dependent on the gasses absorbed by the cathode material.

Maintaining a clean cathode is critical to generation of a uniform and repeatable electron beam. However, since the target to which the electron beam is directed must frequently be introduced and removed from the vacuum chamber, there is an opportunity for contamination of the chamber with atmospheric gasses and impurities. These gasses and impurities may interact with the cathode surface, degrading the uniform emission from the cathode. To insure a uniform emission, the cathode is baked to clean surface impurities from the cathode. This is a time consuming and expensive process.

It is an object of the invention to provide a uniform wide area electron beam. It is a further object to utilize such an electron beam in a chamber for the treatment of target objects.

SUMMARY OF THE INVENTION

The present objects are achieved with a low pressure chamber including at least one grid for plasma containment. A plasma is generated by a plasma source within the chamber. The plasma ions are accelerated through the grid to a high voltage cathode, a semiconductor slice. Impact of the ions on the cathode produces an electron beam having the cross-sectional dimension of the semiconductor slice. The high voltage cathode slice is preferably made of silicon that is doped in variable and graded amounts to produce a beam of desired characteristics, i.e. offsetting beam non-uniformities without doping. Alternatively, the cathode may be made of a semiconductor hybrid material, such as germanium or an alloy. Either of these options allows for a cathode in which the secondary electron emission is spatially designed to either decrease the electron emission in the center of the beam or increase the electron emission outwardly toward the peripheral edge of the beam. This selective doping of a semiconductor material provides for a wide area beam that is more uniform. The silicon cathode is very stable and is available in very precisely engineered specifications that can be handled for selective doping by well known semiconductor manufacturing equipment. The highly controlled production of silicon and other semiconductor wafers produces material with very stable properties and low outgassing.

The generated secondary electron beam is directed back through a grid onto a target. An access port allows introduction of objects into the chamber by irradiation by the beam. A magnet or other means may be used to dither the beam, reducing the variability in the beam that is an artifact of the beam passing through the grid, i.e. eliminating grid shadows.

Plasma generation in the chamber may be effected by a wire anode extending into the chamber. A gas source, such as helium, hydrogen or air, is introduced into the chamber. The gas is ionized by the anode, producing the plasma. Alternatively, a grid extending across the chamber may serve as the anode by connection of the grid to a low voltage power source. In addition, a low voltage used with a grid may be used to control flow of ions reaching the high voltage cathode, thereby controlling the flux of the resulting beam.

DETAILED DESCRIPTION OF THE INVENTION

Figure 1:
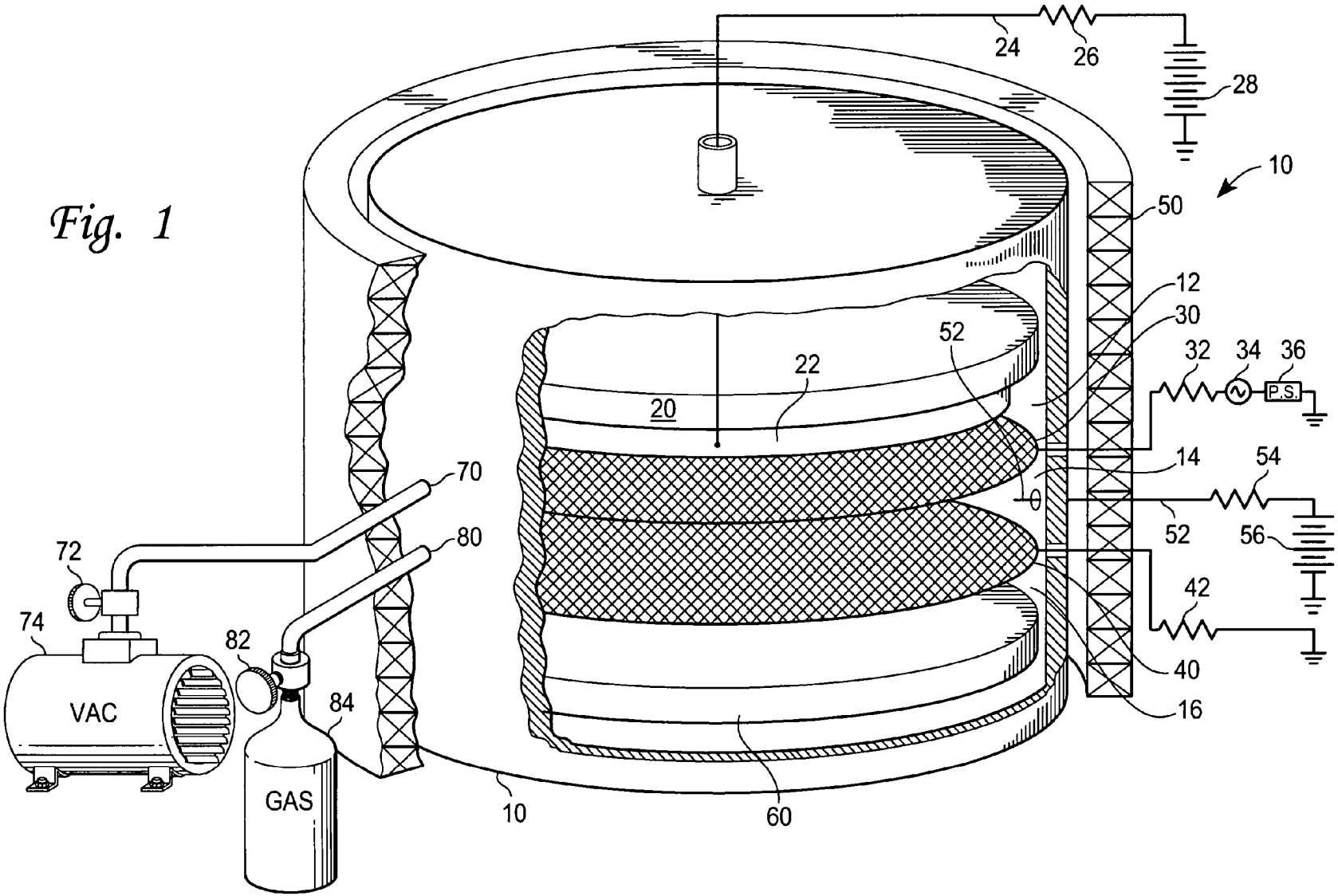
FIG. 1 is a perspective view of one embodiment of an ion plasma electron beam generator.

With respect to FIG. 1, plasma chamber 10 is a very low pressure vessel composed of three internal regions, an upper region 12, a middle region 14 and a lower region 16. The volume within plasma chamber 10 is gas tight, such that the atmosphere within the chamber may be controlled to near vacuum conditions. The areas through which components extend into the chamber (such as the attachment of the gas and vacuum lines, and wires extending into the chamber) may be sealed with O-ring gaskets to ensure the vacuum integrity within the chamber.

The walls of the chamber should be made of a non-magnetic material, such as a ceramic dielectric or stainless steel, so that a magnetic field can penetrate the chamber. The walls of the chamber may be made of aluminum and internally coated with a 2–3 mm. nickel coating.

The plasma will be initially generated in middle region 14. A low volume of gas flows in through inlet 80 from gas tank 84. Flow from tank 84 is controlled by valve 82. The gas may be helium, hydrogen, air or other gas source. Helium has the advantage of being inert and will not react with target objects or system elements. The gas is supplied in an evacuated atmosphere. This is provided by vacuum pump 74 attached to the plasma chamber 10 at vacuum inlet 70. The vacuum pressure may be regulated with valve 72. As an example, helium at 10 to 50 millitorr may be used.

A low temperature plasma, i.e. similar in temperature to a fluorescent tube, is generated by applying a positive voltage to the gas in the chamber, between screen grids 30 and 40, through wire 52 provided by low voltage supply 56. Voltage supply has its negative terminal coupled via resistor 54 to ignition wire 52, which extends through a gas tight, insulated pipe into the interior of plasma chamber 10 in the middle section 14. The voltage of this source is typically several thousand volts, say +3000 Volts. Alternatively, one of the screen grids could be connected to a voltage supply for the generation of the plasma. The screen grids are electrically floating or grounded, conductive wire meshes, similar to window screening in appearance.

The positive ions in the plasma are attracted to the high voltage negative cathode surface 22. The positively charged ions are accelerated by the potential difference between the cathode and the neutral plasma. The positive ions move through upper floating grid 30, which is secured to side walls 8 of plasma chamber 10. The ions are attracted to cathode surface 22 and into upper region 12 where the ions rapidly move to negatively charged cathode surface 22 on fixed mount 20. For example, fixed mount 20 may be a vacuum wafer chuck and cathode surface 22 may be a silicon wafer adapted to be held by the chuck. Voltage supply 28 is coupled via resistor 26 to wire 24, which extends through a gas tight, insulated pipe into the interior of plasma chamber 10 where it is coupled to cathode surface 22. The voltage of this source may be −150 KV, for example.

Upper grid 30 may be used to control the flow of ions to the high voltage cathode surface 22. A variable low voltage power supply 36 has its negative terminal coupled via a resistor 32 to upper grid 30. The grid voltage may be about −500 volts to −1000 volts, moderating the influence of cathode surface 22. A modulator 34 may be coupled between upper grid 30 and variable power supply 36. This allows a variable voltage waveform to be applied to upper grid 30. Control of this voltage allows modulation of the ions passing through upper grid 30 and hence modulation of the output beam so that, for example, a pulsed output beam could be produced, as well as a continuous beam.

In this embodiment, both wire anode 52 and upper grid 30 are illustrated as having separate bias circuits, including an independent power source. Alternatively, it is possible that a single, low voltage power source could be utilized for both these elements.

When a large negative voltage is applied to high voltage cathode surface 22, positive ions are attracted into region 12 and are accelerated towards surface 22. The accelerated positive ions bombard surface 22, causing cathode surface 22 to emit secondary electrons, which form an electron beam. The distribution of electrons forming the electron beam adjacent to surface 22 is substantially the same as the distribution of ions impinging on the cathode surface 22.

The generated electron beam emitted from cathode surface 22 passes through upper region 12, through upper grid 30, moves through central region 14, through grid lower grid 40 and into region 16. The grids are made of fine mesh wire (such as molybdenum wire mesh) having a transparency of roughly 75%, or better. In region 16 the generated electron beam impinges upon target material placed on target platform 60. Target platform 60 and lower grid 40 may be secured to sidewall 8 of the plasma chamber 10. Alternatively, platform 60 may be secured to the bottom of the chamber. Lower grid 40 may be connected through resistor 42 to electrical ground. Items on platform 60 are irradiated by the electron beam.

As previously mentioned, cathode surface 22 is preferably a semiconductor wafer. The properties of semiconductors, particularly silicon, are very well understood, and a silicon surface is known to be very stable. The well established and controlled production of silicon in the semiconductor industry provides a material of high purity with very low outgassing.

A silicon wafer is doped and oxidized in a variable and graded amount to alter the secondary emission coefficient of the cathode material. Wafers are generally round, with a center which would be doped less and outer peripheral regions which would be doped by a radially symmetric greater amount. The graded amount of doping offsets the usual radially outward fall in beam density.

Oxide treatment and wafer thickness, in profile, may also be changed to modify the beam emission characteristic. The wafer can be impregnated by ionic bombardment or the wafer can be treated by chemical vapor deposition in a spatially differing manner to enhance or reduce electron emission. This allows the electron emission to be decreased in the center of the electron beam or increased at the edge of the beam to achieve beam uniformity. This compensates for the uneven nature of a beam on beam formation from a standard anode.

An electromagnet 50 may co-axially surround plasma chamber 10, providing an axial magnetic field that may act upon the generated electron beam. After the electron beam passes through lower grid 40, the magnetic field could act to dither the generated electron beam to compensate for any shadow effect resulting from the electron beam passing through lower grid 40. In addition, the magnetic field could scan the generated electron beam over a larger area of target objects on target platform 60, further insuring a wide beam application. Note that the cylindrical symmetry of the chamber leads to a circular output beam. However, the apparatus need not be cylindrical, but could have any convenient shape, such as a pear shape or a cubic shape, but all have opposed end walls and a side wall.

Figure 2:
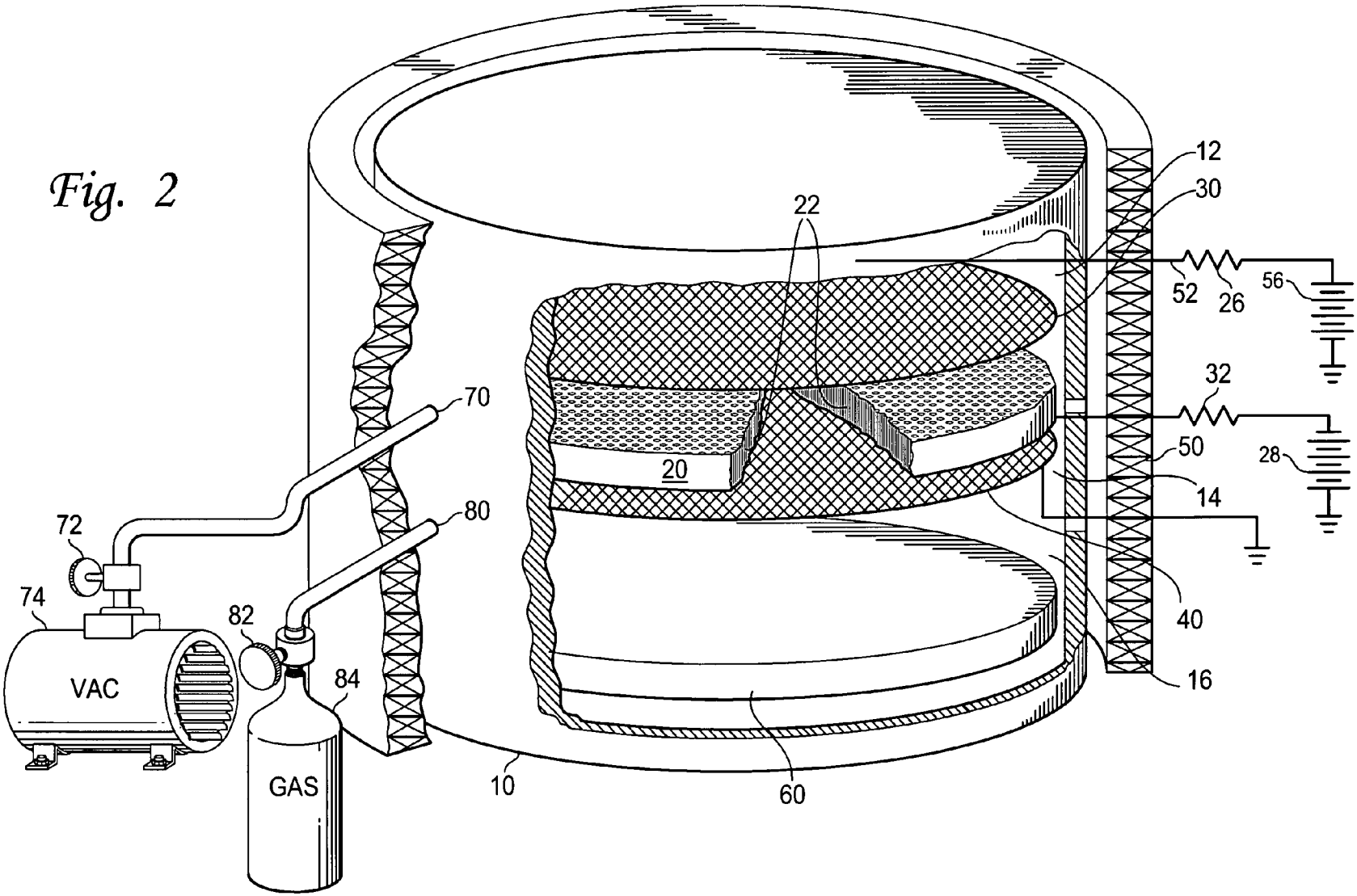
FIG. 2 is a perspective view of a second embodiment of an ion plasma electron beam generator.

With respect to FIG. 2, an alternative embodiment is shown. In this embodiment, the plasma is generated in upper section 12 of plasma chamber 10 by ignition wire 52. As before, a gas supply tank 84 supplies a neutral gas through valve 82 and port 80 into plasma chamber 10 which is pumped down by pump 74 through valve 72 working into port 70. Gas is ionized by charged wire 52 extending into chamber 10. Ions from the plasma in upper section 12 are accelerated into central section 14, through electrically floating or grounded grid 30 and toward the semi-porous cathodic semiconductor slice 22 where the ions bombard the grid 40 through the semiporous slice 22. The grid 40 is slightly spaced from and supported by slice 22. The openings in slice 22 are constricted to promote ionic collisions to liberate electrons that pass through grid 40 towards anodic grid 40. The semiconductor wafer would have a large negative voltage, say −150 KV, while the grid 40 is electrically and mechanically tied to slice 22. An electromagnet 50 can provide a dithering signal to electrons passing through the grid to avoid shadows of the grid on anodic target platform 60.

Semiconductor wafers can be made very thin, yet are self-supporting. A slight amount of central sag is inconsequential. An array of holes is etched in the wafer, making the wafer very porous, allowing ions to strike exposed surfaces, yet emitting secondary electrons that appear to come from the opposite surface but may be generated within the holes of the wafer. As before, the wafer is doped to emit a greater number of electrons radially outwardly so that a uniform electron flux emerges in a wide area beam. A target to be treated by the beam is located near the anode. A door may be provided in the chamber wall for easy movement of target materials.

What is claimed is:

1. A wide area electron beam device comprising, a chamber having a partially evacuated interior enclosed by walls, including first and second end walls and a side wall structure;

a semiconductor slice high voltage cathode near the first end wall of the chamber;

a conductive plate anode near the second end wall of the chamber;

first and second spaced apart wire mesh electrodes defining a spatial volume in relation to the chamber side wall structure, a neutral ion plasma generated within the spatial volume between the first and second wire mesh electrodes, the ion plasma supplying ions to the cathode through one of the first and second wire mesh electrodes, the ions impacting the cathode with sufficient force to cause secondary electron emission having sufficient energy to traverse through the ion plasma toward the anode, thereby forming an electron beam extending over the anode.

2. The electron beam device of claim 1 wherein the semiconductor slice cathode is treated to have a uniform emission of electrons over the surface.

3. The electron beam device of claim 1 wherein the semiconductor slice is a doped semiconductor wafer that has a center and a radially outwardly extending periphery.

4. The electron beam device of claim 3 wherein the doped wafer has a non-uniform distribution of dopant material.

5. The electron beam device of claim 4 wherein the doped wafer has a lesser dopant concentration near the center and increasing amounts of dopant extending radially outwardly.

6. The electron beam device of claim 3 wherein the semiconductor wafer is a germanium wafer.

7. The electron beam device of claim 1 wherein the conductive plate anode is planar.

8. The electron beam device of claim 1 wherein the electron beam extending over the area of the plate has a uniform intensity distribution over the area of the conductive plate anode.

9. The electron beam device of claim 1 wherein a target material for said electron beam is proximate to the anode.

10. The electron beam device of claim 1 wherein said ion plasma is a low temperature plasma.

11. The electron beam device of claim 1 having means for generating a dithering electric field superposed on the electron beam near the conductive plate anode.

12. The electron beam device of claim 1 having means for generating a magnetic field superposed on the electron beam near the conductive plate.

13. A wide area electron beam device comprising, a chamber having a partially evacuated interior enclosed by walls, including first and second end walls and a side wall structure;

first and second spaced apart wire mesh electrodes defining a spatial volume in relation to the chamber side wall structure;

a neutral ion plasma generated within the spatial volume between the first of the spaced apart wire mesh electrodes and a first end wall of the chamber;

a doped semiconductor slice high voltage cathode between the first and second electrodes configured to allow charged particle permeability therethrough and having a high voltage thereon, drawing ions from the plasma through the first wire mesh electrode and producing secondary electrons traveling toward and traversing the second wire mesh grid by means of a positive voltage thereon;

a conductive plate anode near the second wall of the chamber receiving the secondary electrons traversing the second grid thereby forming an electron beam impinging upon a target placed upon the anode.

14. The electron beam device of claim 13 wherein the doped semiconductor slice cathode has a central region at a first dopant concentration and a radially outward second dopant concentration.

15. The electron beam device of claim 14 wherein the non-uniform distribution of dopant material is circularly symmetric.

16. The electron beam device of claim 13 wherein the doped semiconductor slice is a semiconductor wafer.

17. The electron beam device of claim 16 wherein the semiconductor wafer is a silicon wafer.

18. The electron beam device of claim 13 wherein the conductive plate anode is planar.

19. The electron beam device of claim 13 wherein the electron beam extending over the area of the plate has a uniform intensity distribution over the area of the conductive plate anode.

20. The electron beam device of claim 13 wherein a target material for said electron beam is proximate to the anode.

21. The electron beam device of claim 13 having means for generating a dithering electric field superposed on the electron beam near the conductive plate anode.

22. The electron beam device of claim 13 having means for generating a magnetic field superposed on the electron beam near the conductive plate.

* * * * *